US008466100B2

(12) United States Patent
Ponder et al.

(10) Patent No.: US 8,466,100 B2
(45) **Date of Patent: *Jun. 18, 2013**

(54) BENEFIT COMPOSITIONS COMPRISING POLYGLYCEROL ESTERS

(75) Inventors: Jennifer Beth Ponder, Cincinnati, OH (US); Keith Homer Baker, Cincinnati, OH (US); Rajan Keshav Panandiker, West Chester, OH (US); Kerry Andrew Vetter, Cincinnati, OH (US); Robert John Strife, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,196

(22) Filed: May 8, 2012

(65) Prior Publication Data

US 2012/0216353 A1 Aug. 30, 2012

Related U.S. Application Data

(63) Continuation of application No. 13/176,061, filed on Jul. 5, 2011, now abandoned, which is a continuation of application No. 12/541,185, filed on Aug. 14, 2009, now Pat. No. 7,998,915.

(60) Provisional application No. 61/089,080, filed on Aug. 15, 2008.

(51) Int. Cl.

| | |
|---|---|
| ***C11D 3/20*** | (2006.01) |
| ***C11D 9/36*** | (2006.01) |
| ***B08B 3/04*** | (2006.01) |

(52) U.S. Cl.

USPC ..... 510/475; 510/330; 510/331; 510/356; 510/360; 510/421; 510/505; 8/137

(58) Field of Classification Search

USPC ..... 510/330, 331, 356, 360, 421, 475, 510/505; 8/137

See application file for complete search history.

(56) References Cited

U.S. PATENT DOCUMENTS

| | | | | |
|---|---|---|---|---|
| 2,284,127 | A | | 5/1942 | Bruson |
| 3,578,591 | A | | 5/1971 | Lazaridis et al. |
| 4,214,038 | A | * | 7/1980 | McCarty et al. ..... 427/242 |
| 2,120,007 | A | | 7/1985 | Schmit |
| 4,675,022 | A | | 6/1987 | Danner |
| 4,686,365 | A | | 8/1987 | Meek et al. |
| 4,776,965 | A | | 10/1988 | Nuesslein et al. |
| 4,818,421 | A | | 4/1989 | Boris et al. |
| 4,911,852 | A | | 3/1990 | Coffindaffer et al. |
| 5,407,588 | A | | 4/1995 | Butterworth et al. |
| 5,447,643 | A | | 9/1995 | Kelkenberg et al. |
| 5,466,719 | A | | 11/1995 | Jakobson et al. |
| 5,498,350 | A | | 3/1996 | Sakata et al. |
| 5,500,137 | A | | 3/1996 | Bacon et al. |
| 5,510,042 | A | | 4/1996 | Hartman et al. |
| 5,545,350 | A | | 8/1996 | Baker et al. |
| 5,585,506 | A | | 12/1996 | Harvey et al. |
| 5,597,936 | A | | 1/1997 | Perkins et al. |
| 5,599,473 | A | | 2/1997 | Crutzen et al. |
| 5,668,094 | A | | 9/1997 | Bacon et al. |
| 5,700,387 | A | | 12/1997 | Haq et al. |
| 5,726,144 | A | | 3/1998 | Dewez et al. |
| 5,792,219 | A | | 8/1998 | Hartman et al. |
| 5,804,547 | A | | 9/1998 | Godfroid et al. |
| 5,880,086 | A | * | 3/1999 | Weinelt et al. ..... 510/504 |
| 5,965,515 | A | | 10/1999 | Rau |
| 5,985,820 | A | | 11/1999 | Khan-Lodhi et al. |
| 5,998,355 | A | | 12/1999 | Brumbaugh |
| 6,242,499 | B1 | | 6/2001 | Gruning et al. |
| 6,352,701 | B1 | | 3/2002 | Scholz et al. |
| 6,492,322 | B1 | | 12/2002 | Cooper et al. |
| 6,551,986 | B1 | | 4/2003 | Littig et al. |
| 6,642,200 | B1 | | 11/2003 | Zhang et al. |
| 6,733,538 | B1 | | 5/2004 | Panandiker et al. |
| 6,762,159 | B2 | | 7/2004 | Ishitobi |
| 6,878,684 | B2 | | 4/2005 | Ellson et al. |
| 6,890,895 | B2 | | 5/2005 | Oses et al. |
| 7,553,495 | B2 | | 6/2009 | Loeffler et al. |
| 7,625,858 | B2 | | 12/2009 | Mohammadi |
| 7,754,775 | B2 | | 7/2010 | Mercier et al. |
| 7,998,915 | B2 | * | 8/2011 | Ponder et al. ..... 510/356 |
| 2002/0123439 | A1 | | 9/2002 | Ishitobi |
| 2003/0130162 | A1 | | 7/2003 | Llosas et al. |
| 2004/0048766 | A1 | | 3/2004 | Raths et al. |
| 2004/0204337 | A1 | | 10/2004 | Corona et al. |
| 2005/0026808 | A1 | | 2/2005 | Mohammadi et al. |
| 2005/0031580 | A1 | | 2/2005 | Allef et al. |
| 2005/0098759 | A1 | | 5/2005 | Frankenbach et al. |
| 2005/0230634 | A1 | | 10/2005 | Bajic et al. |
| 2006/0025323 | A1 | | 2/2006 | Vlad |
| 2006/0084589 | A1 | | 4/2006 | Vlad et al. |
| 2006/0165627 | A1 | | 7/2006 | Allef et al. |
| 2006/0252668 | A1 | | 11/2006 | Frankenbach et al. |
| 2006/0258558 | A1 | | 11/2006 | Wachter et al. |
| 2006/0264352 | A1 | | 11/2006 | Sajic et al. |
| 2006/0276370 | A1 | | 12/2006 | Zhang et al. |
| 2007/0110696 | A1 | | 5/2007 | Johnson et al. |
| 2007/0116663 | A1 | * | 5/2007 | Iwanaga et al. ..... 424/70.31 |
| 2007/0232515 | A1 | | 10/2007 | Takeuchi et al. |
| 2008/0081023 | A1 | | 4/2008 | Deckner et al. |
| 2008/0108709 | A1 | | 5/2008 | Meyer et al. |
| 2008/0132437 | A1 | | 6/2008 | Zhang et al. |
| 2008/0152611 | A1 | | 6/2008 | Wells et al. |
| 2008/0242584 | A1 | | 10/2008 | Wahl et al. |
| 2009/0029899 | A1 | | 1/2009 | Grainger et al. |
| 2010/0021399 | A1 | | 1/2010 | Rampoldi et al. |
| 2010/0041583 | A1 | | 2/2010 | Ponder et al. |
| 2010/0075890 | A1 | | 3/2010 | Ford et al. |
| 2010/0184634 | A1 | | 7/2010 | Henault et al. |
| 2010/0215598 | A1 | | 8/2010 | Poletti |
| 2011/0201532 | A1 | | 8/2011 | Ponder et al. |
| 2011/0201533 | A1 | | 8/2011 | Ponder et al. |
| 2011/0201534 | A1 | | 8/2011 | Ponder et al. |
| 2011/0201537 | A1 | | 8/2011 | Ponder et al. |
| 2011/0260052 | A1 | | 10/2011 | Ponder et al. |

FOREIGN PATENT DOCUMENTS

| | | | |
|---|---|---|---|
| DE | 4436714 | A1 | 4/1996 |
| DE | 19732073 | C1 | 8/1998 |

(Continued)

OTHER PUBLICATIONS

Wet Strength Resins and Their Applications, edited by L. L. Chan, TAPPI Press (1994), pp. 13-44.

*Primary Examiner* — Brian P Mruk

(74) *Attorney, Agent, or Firm* — James F. McBride; Steven W. Miller

(57) ABSTRACT

The instant disclosure relates to compositions comprising selected polyglycerol esters and a treatment and/or care agent. The disclosed compositions may be useful in fabric care compositions, for example, detergents, fabric softening compositions and the like. Methods of making and using compositions comprising polyglycerol esters and a treatment and/or care agent are also disclosed.

15 Claims, No Drawings

FOREIGN PATENT DOCUMENTS

| | | | |
|---|---|---|---|
| DE | 102006033845 | A1 | 1/2008 |
| EP | 0569028 | A2 | 11/1993 |
| EP | 0684302 | A | 11/1995 |
| EP | 0758641 | A1 | 2/1997 |
| EP | 1488775 | A1 | 12/2004 |
| GB | 439435 | | 9/1934 |
| GB | 0511545 | A | 8/1939 |
| GB | 1571527 | A | 7/1980 |
| JP | 4 342 800 | A2 | 11/1992 |
| JP | 7 003 639 | A2 | 1/1995 |
| JP | 08012995 | A2 | 1/1996 |
| JP | 08176294 | A2 | 7/1996 |
| JP | 08283795 | A2 | 10/1996 |
| JP | 09013079 | A2 | 1/1997 |
| JP | 10218759 | A2 | 8/1998 |
| JP | 10234294 | A2 | 9/1998 |
| JP | 10317000 | A2 | 12/1998 |
| JP | 2000 109 887 | A2 | 4/2000 |
| JP | 2000 160 195 | A2 | 6/2000 |
| JP | 2000 230 191 | A2 | 8/2000 |
| JP | 2000 230 192 | A2 | 8/2000 |
| JP | 2001 152 193 | A2 | 6/2001 |
| JP | 2001 181 966 | A2 | 7/2001 |
| JP | 2001 311 099 | A2 | 11/2001 |
| JP | 2002 060 783 | A2 | 2/2002 |
| JP | 2002 088 393 | A2 | 3/2002 |
| JP | 2002 201 485 | A2 | 7/2002 |
| JP | 2002 201 486 | A2 | 7/2002 |
| JP | 2002 201 487 | A2 | 7/2002 |
| JP | 2002 201 488 | A2 | 7/2002 |
| JP | 2002 201 489 | A2 | 7/2002 |
| JP | 2003 027 086 | A2 | 1/2003 |
| JP | 2003 041 299 | A2 | 2/2003 |
| JP | 2003 048 822 | A2 | 2/2003 |
| JP | 2003 261 416 | A2 | 9/2003 |
| JP | 2004 285 100 | A2 | 10/2004 |
| JP | 2005 036 123 | A2 | 2/2005 |
| JP | 2005 068 083 | A2 | 3/2005 |
| JP | 2005 068 084 | A2 | 3/2005 |
| JP | 2005 089 487 | A2 | 4/2005 |
| JP | 2005 089 571 | A2 | 4/2005 |
| JP | 2005 089 603 | A2 | 4/2005 |
| JP | 2005 200 539 | A2 | 7/2005 |
| JP | 2005 343 844 | A2 | 12/2005 |
| JP | 2006 002 081 | A2 | 1/2006 |
| JP | 2006 028 096 | A2 | 2/2006 |
| JP | 2006 028 229 | A2 | 2/2006 |
| JP | 2006 083 093 | A2 | 3/2006 |
| JP | 2006 124 312 | A2 | 5/2006 |
| JP | 3 886 310 | B2 | 2/2007 |
| JP | 2007 091 823 | A2 | 4/2007 |
| JP | 2007 091 895 | A2 | 4/2007 |
| JP | 2007 137 847 | A2 | 6/2007 |
| JP | 2007 237050 | A | 9/2007 |
| JP | 2008 208 050 | A2 | 9/2008 |
| JP | 2009 073 763 | A2 | 4/2009 |
| WO | WO 96/01616 | A1 | 1/1996 |
| WO | WO 01/08481 | A1 | 2/2001 |
| WO | 02/069889 | A2 | 9/2002 |
| WO | 2006/097207 | A1 | 9/2006 |
| WO | WO 2008/012220 | * | 1/2008 |

* cited by examiner

BENEFIT COMPOSITIONS COMPRISING POLYGLYCEROL ESTERS

CROSS REFERENCES TO RELATED APPLICATIONS

This application is a continuation of and claims priority under 35 USC §120 to U.S. patent application Ser. No. 13/176,061, filed Jul. 5, 2011 now abandoned, which in turn is a continuation of and claims priority under 35 USC §120 to U.S. patent application Ser. No. 12/541,185, filed Aug. 14, 2009 (now U.S. Pat. No. 7,998,915 B2 dated Aug. 16, 2011), which in turn claims priority under 35 U.S.C. §119(e) to U.S. Provisional Application Ser. No. 61/089,080, filed Aug. 15, 2008.

FIELD OF THE INVENTION

The instant disclosure relates to compositions comprising polyglycerol esters (PGEs) and a treatment and/or care agent. Methods of making and using said compositions are also disclosed.

BACKGROUND OF THE INVENTION

Consumer fabric treatment compositions are often formulated to provide improved fabric feel. Such compositions can be formulated, for example, as liquid softening compositions, dryer sheets, or detergent formulations. Unfortunately, depending on the type of softening active used, existing fabric softening compositions can suffer from a variety of disadvantages. For example, currently used actives can be excessively expensive, may, impart a greasy feel to textiles, and in some cases may cause treated fabric to become hydrophobic. In addition, some softening agents, such as quaternary ammonium compounds, can be difficult to formulate with, particularly when combined with anionic surfactants as flocculation/precipitation may occur. Further, there is a need for fabric softening agents that may be used in low water or compacted formulations, in contrast to currently used fabric softening agents which may be difficult to formulate as low-water compositions. Finally, given the concern for environmentally compatible consumer products, there remains the need for fabric care agents having an improved biodegradeability profile, as many fabric treatment agents are released with the wash/treatment water.

Thus, there is a need in the art to provide fabric care actives having improved attributes with respect to one or more of the aforementioned problems. The instant disclosure addresses one or more of the needs described above.

SUMMARY OF THE INVENTION

The instant disclosure relates to compositions comprising polyglycerol esters (PGEs) and a treatment and/or care agent. Methods of making and using said compositions are also disclosed.

DETAILED DESCRIPTION OF THE INVENTION

Definitions

As used herein, the articles including "a" and "an" when used in a claim, are understood to mean one or more of what is claimed or described.

As used herein, the term "comprising" means various components conjointly employed in the preparation of the compositions of the present disclosure. Accordingly, the terms "consisting essentially of" and "consisting of" are embodied in the term "comprising".

As used herein, the term "cationic polymer" means a polymer having a net cationic charge. Polymers containing amine groups or other protonable groups are included in the term "cationic polymers," wherein the polymer is protonated at the pH of the intended use. As used herein, the term "polymer" includes homopolymer, copolymer or terpolymer and polymers with 4 or more type of monomers.

As used herein, an "effective amount" of a material or composition is the amount needed to accomplish an intended purpose, for example, to impart a desired level of fabric care benefit to a substrate.

As used herein, "fabric treatment and/or care compositions" include fabric care compositions for handwash, machine wash and other purposes including fabric care additive compositions and compositions suitable for use in the soaking and/or pretreatment of fabrics. They make take the form of, for example, laundry detergents, fabric conditioners, and other wash, rinse, dryer added products, sprays, or compositions capable of direct application to a textile. The fabric care compositions may take the form of a granular detergent or dryer added fabric softener sheet. The term includes, unless otherwise indicated, granular or powder-form all-purpose or "heavy-duty" washing agents, especially cleaning detergents; liquid, gel or paste-form all-purpose washing agents; liquid fine-fabric detergents; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, "treatment and/or care agent" refers to any of the agents defined in the disclosure herein.

As used herein, the terms "include," "includes," and "including" are meant to be non-limiting.

As used herein, the term "IV," or "Iodine Value" is the number of grams of iodine absorbed per 100 grams of the sample material. The IV range represents the degree of unsaturation, and can be measured by standard AOCS methods.

As used herein, the term "situs" includes paper products, fabrics, garments, hard surfaces, hair and skin.

As used herein, "stable" means that no visible phase separation is observed for a period of at least about two weeks, or at least about four weeks, or greater than about a month or greater than about four months, as measured using the Floc Formation Test, described in USPA 2008/0263780 A1.

As used herein, "unit dose" means an amount of fabric care composition suitable to treat one load of laundry, such as from about 0.05 g to about 100 g, from 10 g to about 60 g, or from about 20 g to about 40 g.

As used herein, the term "% esterification," means the percent or average percent of the total OH groups (represented by, for example, "OR" in Formula I) on the polyglycerol that are esterified. In calculating the % esterification, the total amount of OH groups is assumed to be based on a value of "n+3" with "n" the average degree of oligomerization for the polyglycerols as described above and in Formula 1.

As used herein, "% cyclic" means the percent of PGE's having a cyclic group.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The instant disclosure relates to fabric treatment and/or care compositions comprising polyglycerol esters.

Various uses for polyglycerol esters ("PGEs") are known. See, for example, U.S. Pat. No. 4,214,038 and US 2006/0276370. PGEs are esters typically obtained by reacting polyglycerol and a fatty acid. Polyglycerols may be prepared from glycerin as described in the literature, for example, as described in U.S. Pat. No. 6,620,904. In general, oligomerization of the glycerol unit is an intermolecular reaction between two glycerin molecules to form a diglycerol. Two such oligomers can also be reacted together, or an oligomer can be reacted with an additional glycerin to form yet higher oligomers. Polyglycerols may be converted to polyglycerol esters by typical esterification techniques for example, via reaction with fatty acids, fatty acid chlorides, and the like. The fatty acids used in the esterification can be a mixture of fatty acid chain lengths such as, for example, the fatty acid mixtures derived from coconut oil or tallow. The fatty acids may be saturated or unsaturated, and may contain from about 12 to about 22 carbon atoms, or about 10 to 22 carbon atoms. The fatty acid mixtures derived from natural fats and oils such as, for example, rapeseed oil, peanut oil, lard, tallow, coconut oil, soybean oil can be converted to saturated form by hydrogenation, such processes being readily understood by one of ordinary skill in the art.

Applicants have recognized that by judiciously selecting fatty acid length, the average degree of esterification, the average degree of saturation, and the average number of polyglycerol units (oligomerization) in a PGE, PGE molecules having improved properties, for example, softening, viscosity, biodegradability, or performance of delivery of a perfume benefit can be obtained. Applicants have recognized that specific PGEs having a degree of oligomerization less than about n=1.5 have a decreased softening performance, while PGEs having increased oligomerization have decreased biodegradability properties. Applicants have further recognized that the degree of esterification and the degree of saturation of the fatty acid chain impact softening performance and the feel benefit of PGEs.

In another aspect, Applicants have recognized that the combination of the PGEs disclosed herein and a silicone material results in a synergistic benefit with respect to feel of a fabric. While silicone materials can be used as a lubricant on a fabric surface, inclusion of silicones, in some instances, may result in reduced body/fluffiness of the fabric, particularly when applied to terry towels. The combination of the PGE and silicones, in contrast, provide a smooth surface with increased body to provide a smooth fluffy soft feel benefit. Applicants have further recognized that the inclusion of silicones with the disclosed PGEs results in compositions having a more desirable viscosity.

Applicants have further recognized that there are differences in water solubility among PGEs influence desirability of use. For example, solubilities for monoester diglycerols and higher glycerols are significantly greater than what may be suitable for a composition in which PGE deposition may be desired. In contrast, the corresponding diester solubilities are several orders of magnitude lower and significantly less than typical in wash (or in rinse) concentrations. As such, the monoesters are disfavored where efficient deposition of the PGE may be desired.

Compositions comprising a PGEs having the structure of Formula I:

Formula I

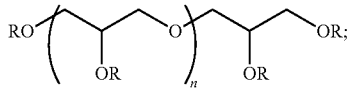

and a treatment and/or care agent are disclosed.

In one aspect, the compositions provide, but are not limited to, performance characteristics that include fabric softening and/or static performance based upon IV ranges. In one aspect, the PGE may be saturated (having an iodine value of about 0 to about 20) or unsaturated (having an iodine value of about 45 to about 135), or may comprise combinations thereof. For example, in one aspect, the PGEs of the compositions have an IV range of from about 40 to about 140; alternatively from about 35 to about 65, alternatively from about 40 to about 60; alternatively from about 1 to about 60, alternatively from about 15 to about 30, alternatively from about 15 to about 25. Further, while it may be acceptable to use cationic softening compounds at a transition temperature from about −50° C. to about 100° C., in one aspect, the disclosed PGEs may have a transition temperature of equal to or less than about 50° C.

In one aspect, the fatty acid carbon chain length may be from about 10 to 22, or about 12 to 18 or about 16 to 18 carbon atoms.

In one aspect, n, for Formula I above, may be about 1.5 to about 6, or about 1.5 to about 3.5 or about 1.5 to about 4.5 or about 1.5 to about 5.

In one aspect, the composition may comprise a PGE of Formula I wherein each R is independently selected from the group consisting of fatty acid ester moieties comprising carbon chains, said carbon chains having a carbon chain length of from about 10 to about 22 carbon atoms; H; and combinations thereof;

wherein a) when n may be from about 1.5 to about 6, the average % esterification of the PGE may be from about 20% to about 100%;

b) when n may be from about 1.5 to about 5, the average % esterification may be from about 20% to about 90% c) when n may be from about 1.5 to about 4, the average % esterification may be from about 20% to about 80%;

wherein more than about 50% of the PGE mixture has at least two ester linkages.

In another aspect, the composition may comprise a PGE of Formula I wherein the fatty acid moieties' carbon chains have an average chain length of from about 10 to about 22 carbon atoms;

wherein the PGE has an iodine value of about 0 to about 145;

wherein a) when n may be from about 3 to about 6, the % esterification may be from about 20% to about 100%;

b) when n may be from about 3 to about 6, the % esterification may be from about 25% to about 90%; and c) when n may be from about 3 to about 6, the % esterification may be from about 35% to about 90%.

In yet another aspect, the composition may comprise a PGE of Formula I wherein the fatty acid moieties' carbon chains have an average carbon chain length of about 16 to 18 carbon atoms;

wherein the PGE has an iodine value of from about 0 to about 20;

wherein a) when n may be from about 1.5 to about 3.5, the % esterification may be from about 20% to about 60%;

b) when n may be from about 1.5 to about 4.5, the % esterification may be from about 20% to about 70%; and c) when n may be from about 1.5 to about 6, the % esterification may be from about 20% to about 80%.

In yet another aspect, the composition may comprise a PGE of Formula I wherein the fatty acid moieties' carbon chains have an average carbon chain length of from about 16 to about 18 carbon atoms;

wherein the PGE has an iodine value of about 45 to about 135; and wherein a) when n may be from about 1.5 to about 3, the % esterification may be from about 70% to about 100%;

b) when n may be from about 1.5 to about 4.5, the % esterification may be from about 50% to 100%; and c) when n may be from about 1.5 to about 6, the % esterification may be from about 25% to 60%.

In a yet further aspect, the composition may comprise a PGE of Formula I, wherein a) when n may be from about 3 to about 6, the % esterification may be from about 15% to about 100%;

b) when n may be from about 3 to about 6, the % esterification may be from about 25% to about 90%;

c) when n may be from about 3 to about 6, the % esterification may be from about 35% to about 90%.

Exemplary commercially available PGEs include Mazol® PGO 31K, Mazol® PGO 104K from BASF; Caprol® MPGO, Caprol® ET from Abitec Corp.; Grindsted® PGE 382, Grindsted® PGE 55, Grindsted® PGE 60 from Danisco; Varonic® 14, TegoSoft® PC 31, Isolan® GO 33, Isolan® GI 34 from Evonik Industries.

In one aspect, the composition may comprise a PGE of Formula I wherein the fatty acid moieties' carbon chains have an average carbon chain length of about 12 to 18 carbon atoms and an iodine value of about 0 to about 145, and when n may be from about 1.5 to about 6, the % esterification may be from about 20% to 80%.

In another aspect, the composition may comprise a PGE having the structure of Formula I, wherein each R may be independently selected from the group consisting of fatty acids having carbon chain lengths of about 12 to 18 carbon atoms, fatty acid moieties having carbon chain lengths of about 15 to 18 carbon atoms, H, and mixtures thereof; wherein the fatty acid may be selected from the group consisting of saturated fatty acids, unsaturated fatty acids, and combinations thereof.

In one aspect, the fatty acid may be saturated, having an IV of about 0 to about 20.

In one aspect, the fatty acid may be branched, linear, or further functionalized, for example, by modification such that the fatty acid contains one or more hydroxyl groups.

In one aspect, at least 50%, or at least 75%, of the PGE molecules comprise at least two ester linkages.

The degree of oligomerization which is represented by "n" is generally understood to be an average representing a distribution of oligomers.) While applicants have recognized that the number of polyglycerol units may be as large as greater than about 10, such molecules have decreased biodegradability and are therefore disfavored. The structure of Formula I is intended to include both linear and/or branched structures. The control of the degree and distribution of oligomers may be controlled to some extent by either physical means (e.g., distillation) or by varying the reaction conditions, as described in U.S. Pat. No. 6,620,904.

In another aspect, the PGEs may further comprise one or more cyclic polyglycerol ("CPG"). In addition to the above oligomerization reaction, an equivalent intramolecular reaction can occur within an oligomer to for a cyclic analog to the oligomer. The formation of cyclic groups reduces the number of free OH groups relative to non-cyclics. The % cyclic, as used herein, indicates the percent of PGE's having a cyclic group. Applicants have observed that as chain length increases, biodegradability of the PGE decreases. Without intending to be limited by theory, applicants believe that the decrease in biodegradability could be attributed to either the increase in oligomerization itself, or rather, to the increase in cyclic structures that are prone to occur as oligomerization may be increased, or to a combination of both.

In one aspect, the composition may comprise, based on total weight of the composition, from about 5% to about 70%, or from about 10% to about 50%, or from about 15% to about 30% of a PGE.

In one aspect, the composition may comprise a PGE comprising at least a diester. In one aspect, the PGE may comprise, based on total weight of the PGE, from about 50% to about 100% of a diester. In yet another aspect, the PGEs of the instant composition comprise a diester, a triester, a tetraester, a hexaester or an octaester, for example, greater than about 50% of an diester, a triester, a tetraester, pentaester, a hexaester, a heptaester, or an octaester, or combinations thereof.

In one aspect, the PGE may comprise, based on total weight of the PGE, from about 50% to 100%, or from about 75% to about 90%, of an ester linkages selected from the group consisting of a diester, a triester, a tetraester, a hexaester, a heptaester, an octaester, and combinations thereof.

In a yet further aspect, from about 1% to about 50% or from about 5% to about 20% or less than about 10% of the PGE may comprise a monoester.

In one aspect, the composition may comprise an emulsifier. Said emulsifier may be selected from the group consisting of cationic surfactants, anionic surfactants, nonionic surfactants, and mixtures thereof.

In one aspect, the compositions may have a pH from about 2 to about 11, or from about 2 to about 9.5, or from about 2 to about 5. In one aspect, the composition may have a pH from about 2.5 to about 4. In one aspect, the composition is stable at a pH of from about 5.5 to about 8.

The disclosed compositions may include a variety of fabric care compositions, such as, for example, fabric enhancer compositions in which a feel benefit, such as softening benefit, is desired. Suitable "treatment and/or care agents"

include any known material suitable for the treatment or care of fabrics or other situs, for example, polymers, including cationic polymers, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, perfume and/or perfume delivery systems, structure elasticizing agents, fabric softeners, carriers, hydrotropes, processing aids and/or pigments.

In one aspect, the treatment and/or care agent may be selected from the group consisting of organosilicones, quaternary ammonium compounds, and combinations thereof.

In one aspect, the treatment and/or care agent may comprise an organosilicone. Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200 Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In another aspect, the functionalized siloxane polymer may comprise an aminosilicone. Suitable aminosilicones are described in U.S. Pat. Nos. 7,335,630 B2, 4,911,852, and USPA 2005/0170994A1. In one aspect the aminosilicone may be that described in U.S. PA 61/221,632. In one aspect, the aminosilicone may comprise the structure of Formula II:

$$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula II)}$$

wherein i. $R_1$, $R_2$, $R_3$ and $R_4$ may each be independently selected from H, OH, $C_1$-$C_{20}$ alkyl, $C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

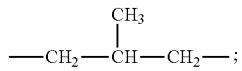

iii. Each Z may be independently selected from —$N(R_5)_2$; —$N(R_5)_3A^-$,

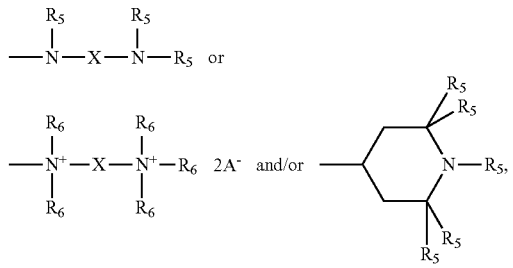

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv. k may be an integer from about 3 to about 20, or from about 5 to about 18 more or from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0;

In one aspect, $R_1$ may comprise —OH. In this aspect, the organosilicone may be amodimethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

In another aspect, the functionalized siloxane polymer may comprise silicone-urethanes, such as those described in U.S. PA 61/170,150. These are commercially available from Wacker Silicones under the trade name SLM-21200.

When a sample of organosilicone is analyzed, it is recognized by the skilled artisan that such sample may have, on average, non-integer indices for Formula I and II above, but that such average indice values will be within the ranges of the indices for Formula I and II above.

In one aspect, the treatment and/or care agent may comprise an additional fabric softening compounds. Suitable fabric softening compounds are disclosed in USPA 2004/0204337.

In one aspect, the fabric softening active may comprise a quaternary ammonium compound. In one aspect, the quaternary ammonium compound may comprise a quaternary ammonium compound selected from the group consisting of an ester quaternary ammonium compound, an alkyl quaternary ammonium compound, or mixtures thereof.

In one aspect, the ester quaternary ammonium compound may comprise a mixture of mono- and di-ester quaternary ammonium compound. Those skilled in the art will recognize that cationic softening compounds can be selected from mono-, di-, and tri-esters, as well as other cationic softening compounds, and mixtures thereof, depending on the process and the starting materials, and that cationic softening compounds can be selected from tertiary ammonium compounds, as well as other cationic softening compounds, and mixtures thereof. Additional suitable fabric softening compounds are disclosed in USPA 2004/0204337. In one aspect, the composition may comprise a biodegradable quaternary ammonium compound. In one aspect, the composition may comprise a biodegradable quaternary ammonium compound and a biodegradable PGE in a chemically stable matrix.

In one aspect, the composition may comprise a quaternary ammonium composition having from about 0.1% to about 30% of mono-ester quaternary ammonium, or from about 0.5% to about 20% of mono-ester quaternary ammonium, by weight of fabric enhancer, or from about 2% to about 12% of mono-ester quaternary ammonium, by weight of the composition.

In one aspect, the composition may comprise from about 1%, or from about 2%, or from about 3%, or from about 5%, or from about 10%, or from about 12%, to about 90%, or to about 40%, or to about 30%, or to about 20%, or to about 18%, or to about 15%, of said quaternary ammonium compound, by weight of the composition.

In one aspect, the composition may comprise a PGE and a quaternary ammonium compound at a ratio of from about 100:1 to about 1:1, or about 20:1 to about 1:1, or about 10:1 to about 1:1. In one aspect, the amount of quaternary ammonium compound may exceed the amount of PGE in the composition.

In one aspect, the composition comprising the PGE and the quaternary ammonium compound may have a pH from about 2.5 to about 4.

In one aspect, the treatment and/or care agent may comprise a perfume and a cationic polymer.

In one aspect, the treatment and/or care agent may comprise a perfume, and a quaternary ammonium compound.

In yet another aspect, the treatment and/or care agent may comprise a perfume, a cationic polymer and a quaternary ammonium compound.

Additional Treatment and/or Care Agents—While not essential, the non-limiting list of materials illustrated hereinafter are suitable for use in the instant compositions and may be desirably incorporated in certain aspects, for example to assist or enhance cleaning performance, for treatment of the substrate to be cleaned, or to modify the aesthetics of the cleaning composition as may be the case with perfumes, colorants, or the like. The precise nature of these additional components, and levels of incorporation thereof, will depend on the physical form of the composition and the nature of the cleaning operation for which it is to be used. Suitable adjunct materials include, but are not limited to, surfactants, builders, chelating agents, dye transfer inhibiting agents, dispersants, enzymes, and enzyme stabilizers, polymeric dispersing agents, structurants, clay soil removal/anti-redeposition agents, brighteners, suds suppressors, perfumes, structure elasticizing agents, fabric softeners, carriers, hydrotropes, processing aids, solvents and/or pigments.

Certain aspects of Applicants' compositions do not contain one or more of the following materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, perfumes and/or perfume delivery systems, structure elasticizing agents, fabric softeners, carriers, hydrotropes, processing aids and/or pigments.

The treatment and/or care agents may include those listed below. Suitable examples of such other treatment and/or care agents and levels of use may also be found in U.S. Pat. Nos. 5,576,282, 6,306,812 B1 and 6,326,348 B1:

Surfactants—In one aspect, the fabric care compositions may comprise from about 0.01% to 80% by weight of a surfactant, or about 1% to about 50% of a surfactant. Surfactants utilized can be of the anionic, nonionic, zwitterionic, ampholytic or cationic type or can comprise compatible mixtures of these types. Detergent surfactants useful herein are described in, for example, U.S. Pat. Nos. 3,664,961, 3,919,678, 4,222,905, and 4,239,659. Anionic and nonionic surfactants are useful if the fabric care product is a laundry detergent, for example, those described in U.S. Pat. Nos. 6,020,303 and 6,593,285. Cationic surfactants are generally useful if the fabric care product is a fabric softener.

Anionic Surfactants—Useful anionic surfactants can themselves be of several different types, for example, the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates and alkyl alkoxy sulfates, especially those obtained by sulfating the higher alcohols ($C_{8-18}$ carbon atoms).

Other anionic surfactants useful with the compositions described herein are the water-soluble salts of: paraffin sulfonates containing from about 8 to about 24 (alternatively about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids. In another aspect, the anionic surfactant may comprise a $C_{11}$-$C_{18}$ alkyl benzene sulfonate surfactant; a $C_{10}$-$C_{20}$ alkyl sulfate surfactant; a $C_{10}$-$C_{18}$ alkyl alkoxy sulfate surfactant, having an average degree of alkoxylation of from 1 to 30, wherein the alkoxy may comprise a $C_1$ to $C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy may comprise a $C_1$ to $C_4$ chain and mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

Nonionic Surfactants—In addition to the anionic surfactant, the fabric care compositions may further contain a nonionic surfactant. The compositions may contain up to about 30%, alternatively from about 0.01% to about 20%, more alternatively from about 0.1% to about 10%, by weight of the composition, of a nonionic surfactant. In one aspect, the nonionic surfactant may comprise an ethoxylated nonionic surfactant. Examples of suitable non-ionic surfactants are provided in U.S. Pat. No. 4,285,841, Barrat et al, issued Aug. 25, 1981. Suitable for use herein are the ethoxylated alcohols and ethoxylated alkyl phenols of the formula $R(OC_2H_4)_n$ OH, wherein each R may be independently selected from the group consisting of aliphatic hydrocarbon radicals containing from about 8 to about 15 carbon atoms and alkyl phenyl radicals in which the alkyl groups contain from about 8 to about 12 carbon atoms, and the average value of n may be from about 5 to about 15. Additional non-limiting examples are disclosed in U.S. Pat. No. 2,965,576 and U.S. Pat. No. 2,703,798.

Cationic Surfactants—The fabric care compositions may contain up to about 30%, from about 0.01% to about 20%, or from about 0.1% to about 20%, by weight of the composition, of a cationic surfactant. Useful cationic surfactants include those which can deliver fabric care benefits. Non-limiting examples of useful cationic surfactants include: fatty amines; quaternary ammonium surfactants; and imidazoline quat materials.

Amphoteric Surfactants—Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 for examples of ampholytic surfactants.

Builders—The compositions may comprise one or more detergent builders or builder systems.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions may also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination may be a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' compositions may include catalytic metal complexes. Suitable catalysts are disclosed, for example, in U.S. Pat. Nos. 4,430,243, 5,576,282, 5,597,936, 5,595,967, 5,597,936, and 5,595,967. Compositions may also include a transition metal complex of a macropolycyclic rigid ligand "MRL". The compositions and cleaning processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor. Suitable transition-metals in the instant transition-metal bleach catalyst include manganese, iron and chromium. Other suitable MRL's herein are a special type of ultra-rigid ligand that may be cross-bridged such as 5,12-diethyl-1,5,8,12-tetraazabicyclo[6,6,2]hexadecane. Suitable transition metal MRLs are readily prepared by known procedures, such as taught for example in WO 00/32601, and U.S. Pat. No. 6,225,464.

Fabric Softening Actives—The composition may comprise additional fabric softening actives (FSA) or a mixture of more than one FSAs such as those described in U.S. patent application Ser. No. 11/890,924.

Deposition Aid—In one aspect, the fabric treatment composition may comprise from about 0.01% to about 10%, from about 0.05 to about 5%, or from about 0.15 to about 3% of a deposition aid. Suitable deposition aids are disclosed in, for example, U.S. patent application Ser. No. 12/080,358.

In one aspect, the deposition aid may be a cationic or amphoteric polymer. In one aspect, the deposition aid may be a cationic polymer. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in WO 00/56849 and U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneinine useful herein is that sold under the tradename Lupasol® by BASF, AG, Lugwigschaefen, Germany.

In another aspect, the treatment composition may comprise an amphoteric deposition aid polymer so long as the polymer possesses a net positive charge. Said polymer may have a cationic charge density of about 0.05 to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the deposition aid may comprise polyethyleneimine or a polyethyleneimine derivative. In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidoproply trimethylammonium cation. In another aspect, the deposition aid may comprise poly(acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the tradename Rheovis® CDE, available from Ciba Specialty Chemicals, a BASF group, Florham Park, N.J., or as disclosed in USPA 2006/0252668.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomanan, cationic guar gum, cationic or amphoteric starch, and combinations thereof.

Another group of suitable cationic polymers may include alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994), at pp. 13-44.

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 to about 5,000,000, or from about 1,000 to about 2,000,000, or from about 2,500 to about 1,500,000 Daltons, as determined by size exclusion chromatography relative to polyethyleneoxide standards with RI detection. In one aspect, the MW of the cationic polymer may be from about 500 to about 37,500 Daltons.

In one aspect, the composition may comprise an adjunct selected from the group comprising a paraffin or perfume containing microcapsule such as those described in U.S. patent application Ser. Nos. 11/145,904; and 11/706,675; U.S. Pat. No. 4,675,022; JP 7,003,639.

In one aspect, the composition may be in a form selected from the group consisting of solid powder, tablet, liquid, gel, and combinations thereof. In one aspect, the composition may be in a unit dose form selected from the group consisting of a tablet, a pouch, and combinations thereof.

In one aspect, an article comprising the composition described herein is disclosed. The article may be selected from the group consisting of bars, sticks, substrate-laden products such as dryer-added sheets, dry and wetted wipes and pads, non-woven substrates, sponges, containers capable of delivering a spray and/or a mist, and combinations thereof.

In one aspect, a method of treating and/or cleaning a situs comprising the steps of a) optionally washing and/or rinsing said situs; b) contacting said situs with a co-particle and/or the product described herein; and c) optionally, washing and/or rinsing said situs is disclosed. In one aspect, a situs treated with the composition described herein is disclosed.

Methods of Characterizing PGE Samples

In one aspect, a method for characterizing a sample containing a PGE is disclosed, wherein said method may comprise the steps of a. combining a sample comprising a PGE with an ionization aid, wherein said ionization aid may be soluble in the solvent to produce an ionized sample;
b. using a Fourier transform mass spectrometer to generate ionized sample data
c. normalizing mass mapping the raw data, wherein said normalizing may be based on a moiety that is a repeat unit of the PGE.
d. optionally, using said map to characterize said PGEs.

In one aspect, the repeat unit may comprise a glycerol unit. In one aspect, the ionization aid may be a compound comprising a cation and an anion, wherein the cation has an affinity for the PGE to be analyzed. In one aspect, the ionization aid may comprise a cation selected from the group consisting of sodium, potassium, ammonium, lithium, and mixtures thereof, and an anion selected from the group consisting of fluoride, chloride, bromide, iodide, formate, acetate, proprionate, and mixtures thereof.

In one aspect, a sample comprising a PGE can be characterized as follows.

First, the sample to be analyzed may be prepared by dissolving the PGE at 1 mg/mL in 50/50 isopropanol-methanol (v/v) solution containing 10 mM ammonium acetate. If the solution is cloudy, chloroform may be added dropwise until clear. Final dilutions to 100-500 ng per microliter are made with the same procedure.

The sample is then subjected to an ionization step, wherein the sample is infused directly to an electrospray ionization (ESI) source operated under typically applicable conditions. Autotuning may be applied to optimize the source conditions as is understood in the art. In one aspect, the flow rate may be about 10 microliter per minute.

The sample is then subjected to an "M/Z analysis" step. In one aspect, a minimum of 60,000 resolution (m/dm peak width at half-height definition) may be applied to resolve all components.

The analysis may be carried out by Fourier Transform Mass Spectrometry ("FTMS"). In one aspect, the hybrid linear ion trap—Orbitrap FTMS, available from Thermoelectron Corp., San Jose Calif., may be used according to the manufacturer's guidelines for obtaining high resolution FTMS data.

The data obtained in the M/Z analysis step may then be analyzed in a Post Acquisition Data Analysis step. In this step, the FTMS mass spectrum may be visually inspected for peak shapes and total ion current (TIC) stability. A minimum of 10 spectra may be averaged and the m/z values may be displayed out to five decimal places. The spectral box view may then be switched to m/z list mode, viewing the numeric values of all m/z peaks in the m/z range (100-2000 daltons is typical) above 1% relative intensity. The list may then be exported to the exact mass clipboard.

The data may then be subjected to the following steps prior to normalized mass mapping, using, for example, an Excel based-custom macro. The macro may compare the exact mass values of the spectrum to a stored list of m/z values for all theoretically possible members of the PGE-ester family, including single and double dehydrated forms within a 5 ppm window.

Carbon-13 isotope peaks may then be identified by the fact that they must have a neighboring peak within 1.00335 mass units. The intensities of these 13-C peaks may then be added to the neighbor peak, and the 13C m/z listing is removed from the spreadsheet. This step reduces the complexity of the normalized mass map.

If a molecule is ionized in more than one way, those states may be identified by m/z difference. For example, ionization by ammonium cation results in an m/z signal at M+18.033826 mass units, above M. Ionization by a sodium cation produces a signal at 22.98922 mass units above M. If both types of signals are present in the mass spectrum, two peaks will appear in the mass list, 4.95539 units apart. The search and identify algorithm allows for a 5 ppm tolerance on the actual values. The intensities of the two ionization states may be added, and placed at the listing for the M+ ammonium cation. The line for the M+ sodium type may be deleted. In this way, a single intensity value for each PGE species is obtained.

The resulting data may then be subjected to a mapping step. Normalized mass mapping results in compounds of a similar chemical structure "lining up" in a mass map. For example, all molecules differing by only their number of glycerol subunits can be caused to "line-up" in a horizontal row in a normalized mass map.

The exact mass of the repeating glycerol subunit is 74.0367792. Normally, as glycerol ("GLY") subunits are added, the m/z decimal value will shift 0.0367792 units. As such, inspecting m/z values in a normal mass spectrum is very labor intensive and there are no obvious geometric relationships in the 2D-bar chart graph that constitutes a mass spectrum (relative intensity vs exact m/z value). By multiplying the m/z value of a PGE by a normalization factor of 74/74.0367792, all molecules having structures different by only glycerol subunit number, will have the same decimal m/z. That is, the usual mass shift caused by addition of a glycerol subunit has been flattened to zero (see exact mass and normalized mass below). This is illustrated below for diglycerol monolaurate and triglycerol monolaurate,

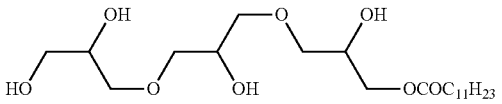

$C_{21}H_{42}O_8$
Exact Mass: 422.28797
422.0782

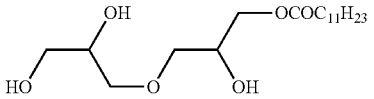

$C_{18}H_{36}O_6$
Exact Mass: 348.25119
348.0782

The whole number part of the normalized value (X=348 and 422 in the example) can then be plotted versus the decimal part of the value (Y=0.0782) as a point or dot. The two dots will lie on a horizontal line. On a complicated map with hundreds of components (dots), all dots lining up horizontally vary only by glycerol number. Other chemical changes, such as addition of ester groups, or double bonds, cause distinct, predictable shifts in the "dot" positions.

Mapping reduces a complex mass spectrum from a bar chart of intensity versus exact mass position that is difficult to interpret to a post-acquisition-sorted series of dots that have distinct chemical relationships, speeding interpretation and identification.

When using data management programs such as Microsoft Excel, different sort functions can be applied using a macro that classifies each m/z peak by glycerol number, ester number, C═C number, total ester alkyl content, cyclic and non-cyclic forms. This allows one to derive physical-chemical parameters such as average glycerol backbone number, for example. In this function, all peak listings are grouped by glycerol number. For example, the diglycerol or its esters would be referred to as "GLY2" with a value of n=1 according to the structure of Formula I. The intensity values within a group (e.g. all GLY1 listings) may be summed. Values for GLY1, GLY2, GLY3, etc may be obtained in this manner. This new family of values is normalized to a sum of 1.0, that is, each is represented as a fraction of the sum. Then, each number is weighted (i.e., multiplied) by its respective glycerol number (1, 2, 3, etc). These new values can then be summed to get the total average glycerol number. Other calculation examples are analogous for sortings done by ester chain number, ester chain length (# of alkyls), cyclics verus non-cyclics, percent C═C content and average molecular weight, from which iodine values can be derived. Other m/z normalizations may be selected to make chemically similar compounds align.

EXAMPLES

Example

Methods of Making Liquid Softener Compositions Comprising PGE

PGE materials are first emulsified to obtain an ending concentration of 25% PGE, 5% cetyl trimethylammonum-chloride (CTMAC) and 3.2% TMN-6 (nonionic surfactant available from Dow Corning). The PGE raw material may then be heated until just above its melting point then mixed with the TMN-6 and stirred until evenly mixed. This mixture is then added slowly to a heated (melting temp of PGE) container containing CTMAC and mixed with an overhead mixer (IKA Lobartechnik, model #RWZODZM-N) at 1500 rpm until all of the PGE/TMN-6 is added and a creamy white emulsion is obtained. Deionized water is added slowly to mixture while being stirred at 1500 rpm to obtain desired end concentration. The mixture is cooled in ice bath to room temperature.

The PGE emulsion is then mixed with premade quat softener base, such as that described in U.S. Pat. No. 6,492,322 B1 using a Hauschild Engineering Speed Mixer (model #DAC60FV2) at 3000 rpm for 2 minutes. D.I. water is then added to the softener system and speed-mixed at 3000 rpm for 1 minute. Next the deposition aid polymer is added and the system is speed-mixed at 3000 rpm for 1 minute. The perfume is then added and speed-mixed at 3000 rpm for 2 minutes. pH of system is then adjusted to 3.2 using concentrated HCL and speed-mixed for 3000 rpm for 1 minute. Finial LFE formulation is a creamy white liquid.

Example

Diesterification of Triglycerol Using $C_{16}$ and $C_{18}$ Acid Chlorides

A 12.89 g (0.054 mol) of triglycerol (Fluka≧80%) is placed into a dry, 500-ml, 3-neck, round-bottom flask equipped with mechanical stirring, thermometer, condenser, and positive $N_2$. A 76-ml sample of anhydrous THF is transferred by canula into the flask. The flask is then placed in an oil bath and heated to 48° C. After heating, 0.79 g (0.006 mol) 4-(dimethylamino)pyridine (Alfa Aesar 99%) and 10.88 g (0.107 mol) triethylamine (Aldrich) are added to the flask followed by 27-mls of Tetrahydrofuran (Oxacyclopentane) to rinse in $Et_3N$. 14.98 g (0.054 mol) palmitoyl acid chloride (Aldrich, 98.5%) and 16.43 g (0.054 mol) stearoyl acid chloride (TCI, 99%) are then mixed in a 125-ml addition funnel with 53-mls THF. The solution of acid chlorides is then dripped into the clear, 48° C. solution of triglycerol and is accompanied by an exotherm that is controllable by rate of addition. The mix becomes white as $Et_3N.HCl$ is formed. A 14-mls THF sample is then used to rinse in all the acid chlorides. The reaction mixture is mixed for 2-hrs. The oil bath is then removed and the mixture is allowed to come to room temperature. The cooled mixtures are concentrated by Rotavap to a solid and then dissolved in methylene chloride and filtered through Whatman #1 filter paper and Celite. The filtrate is then put into a 1-L separatory funnel and washed 2× with a saturated solution of NaCl and 1× with $H_2O$. The $CH_2Cl_2$ layer is dried with $Na_2SO_4$. The $Na_2SO_4$ from the resulting solution is filtered off and the remaining solution is then rotavaped to remove the $CH_2Cl_2$. A 36.5 g sample of a waxy, white solid may be recovered for a 91% yield.

Example

Esterification of a Hexaglycerol $C_{16}/C_{18}$ Triester to Make the $C_{16}/C_{18}$ Octaester A 10.50 g (0.009 mol) sample of hexaglycerol C16/C18 triester (Grindsted PGE 215, available from Danisco A/S, Denmark, is placed into a dry, 250-ml, 3-neck, round-bottom flask equipped with mechanical stirring, thermometer, condenser, and positive $N_2$. 35-mls of anhydrous THF is transferred by canula. The following is then added: 0.13 g (0.001 mol) 4-(dimethylamino)pyridine (Alfa Aesar 99%) and 4.36 g (0.043 mol) triethylamine (Aldrich) with a small amount of THF used to rinse in the $Et_3N$. The flask is then placed in an oil bath and taken to 48° C. 6.00 g (0.022 mol) palmitoyl acid chloride (Aldrich, 98.5%) and 6.58 g (0.022 mol) stearoyl acid chloride (TCI, 99%) are mixed into a 125-ml addition funnel with 30-mls THF. The solution of acid chlorides is then dripped into the 48° C. solution of hexaglycerol triester accompanied by an exotherm that is controllable by rate of addition. The mix becomes white as $Et_3N.HCl$ is formed. A small amount of THF is used to rinse in all the acid chlorides. After the resulting mixture mixes for approximately 4.5-hrs, the oil bath is removed, and the solution allowed to mix and cool to room temperature. The cooled mixture is concentrated by rotavap to a solid. The resulting solid is put in ether and filtered through Whatman #4 paper with Celite. The filtrate is placed into a separatory funnel and washed 2× with a saturated solution of NaCl and 1× with $H_2O$. The ether layer is dried with $Na_2SO_4$. The $Na_2SO_4$ is filtered off and then rotavaped to remove the ether. A 21.09 g sample of a brittle, white solid is obtained for a 99% yield.

Examples of Softening Compositions using the PGEs described herein are listed in Tables I and II. Table III exemplifies laundry detergents in accordance with the instant disclosure.

TABLE I

Rinse-Added Compositions Examples 1-7.

| Component Material | 1 | 2 | 3 | 4 | 5 | 6 | 7 |
|---|---|---|---|---|---|---|---|
| | Wt % | | | | | | |
| PGE-1 [a] | 10 | 10 | 0 | 0 | 20 | 0 | 0 |
| PGE-2 [b] | 0 | 0 | 10 | 10 | 0 | 14 | 14 |
| CTMAC [c] | 2 | 2 | 2 | 2 | 3 | 3 | 3 |
| Silicone-1 [d] | 0 | 5 | 0 | 5 | 2 | 2.5 | 0 |
| Silicone-2 [e] | 5 | 0 | 5 | 0 | 0 | 0 | 2.5 |
| Tergitol TMN-6 [f] | 1.4 | 1.4 | 1.4 | 1.4 | 2 | 1 | 1 |
| Perfume | 1.5 | 1.5 | 1.5 | 1.5 | 1.5 | 1.5 | 1.5 |
| Deposition agent-1 [g] | 2 | 0 | 0 | 0 | 0 | 0 | 0 |
| Deposition agent-2 [h] | 0.5 | 0.5 | 0 | 0 | 0.5 | 0.5 | 0.5 |
| Deposition agent-3 [i] | 0 | 0 | 0.5 | 0 | 0 | 0 | 0 |
| Deposition agent-4 [j] | 0 | 0 | 0 | 0.5 | 0 | 0 | 0 |
| Lactic acid | 0.5 | 0.5 | 0.5 | 0.5 | 0.5 | 0.5 | 0.5 |
| Proxel [k] | 0.1 | 0.1 | 0.1 | 0.1 | 0.1 | 0.1 | 0.1 |
| Dantoguard [l] | 0.15 | 0.15 | 0.15 | 0.15 | 0.15 | 0.15 | 0.15 |

TABLE I-continued

Rinse-Added Compositions Examples 1-7.

| Component Material | 1 | 2 | 3 | 4 | 5 | 6 | 7 |
|---|---|---|---|---|---|---|---|
| | Wt % | | | | | | |
| TMBA [m] | 0.05 | 0.05 | 0.05 | 0.05 | 0.05 | 0.05 | 0.05 |
| DPTA [n] | 0.05 | 0.05 | 0.05 | 0.05 | 0.05 | 0.05 | 0.05 |
| Water | Balance to 100% | | | | | | |

[a] PGE-1 = Polyglycerol Ester with average glycerol chain length of 3 and average esterification of 2.
[b] PGE-2 = Polyglycerol Ester with average glycerol chain length of 4.5 and average esterification of 6.
[c] CTMAC = Cetyl Trimethyl Ammonium Chloride
[d] Silicone-1 = SLM-21200 from Wacker Silicones
[e] Silicone-2 = KF-873 from Shin-Etsu Silicones
[f] Nonionic surfactant derived from 2,6,8-trimethyl-4-nonanol with ethylene oxide.
[g] Catatonically modified starch from National Starch
[h] Polyvinylamine (PVAm) from BASF
[i] Polytheylenimine (PEI) from BASF
[j] Polyacrylamide Methacrylate amidopropyl/Trimethylammonium Chloride (PAM/MAPTAC) from NALCO
[k] Proxel = 1,2 Benzisothiozolin-3-one
[l] Dantoguard = Dimethylol-5,5-Dimethylhydanotoin
[m] TMBA = Trimethoxy Benzoic Acid
[n] DTPA = Sodium Diethylene Triamine Pentaacetate from NALCO

TABLE II

Rinse-Added Compositions Examples 8-12

| Ingredient | 8 (wt %) | 9 (wt %) | 10 (wt %) | 11 (wt %) | 12 (wt %) |
|---|---|---|---|---|---|
| PGE-1[a] | 10 | 10 | 10 | 0 | 0 |
| PGE-2[b] | 0 | 0 | 0 | 10 | 10 |
| CTMAC[c] | 3 | 3 | 3 | 3 | 3 |
| Tergitol TMN-6[d] | 2 | 2 | 2 | 2 | 2 |
| Perfume | 1.5 | 1.5 | 1.5 | 1.5 | 1.5 |
| Deposition agent-1[e] | 0 | 0 | 0 | 0.25 | 0 |
| Deposition agent-3[g] | 0.25 | 0.25 | 0.25 | 0 | 0.25 |
| DEEDMAC[m] | 0 | 5 | 0 | 0 | 0 |
| DTDMAC[n] | 5 | 0 | 0 | 0 | 0 |
| TEA QUAT 1[o] | 0 | 0 | 0 | 5 | 5 |
| Glycerin | 0 | 0 | 5 | 0 | 0 |
| Lactic acid | 0.5 | 0.5 | 0.5 | 0.5 | 0.5 |
| Proxel[i] | 0.1 | 0.1 | 0.1 | 0.1 | 0.1 |
| Dantoguard[j] | 0.15 | 0.15 | 0.15 | 0.15 | 0.15 |
| TMBA[k] | 0.05 | 0.05 | 0.05 | 0.05 | 0.05 |
| DPTA[l] | 0.05 | 0.05 | 0.05 | 0.05 | 0.05 |
| HCl[p] | 0.03 | 0.03 | 0.03 | 0.03 | 0.03 |
| DC2310[q] | 0.15 | 0.15 | 0.15 | 0.15 | 0.15 |
| CaCl2[r] | 0.59 | 0.59 | 0.59 | 0.59 | 0.59 |
| Kathon[s] | 0.03 | 0.03 | 0.03 | 0.03 | 0.03 |
| Water | Balance to 100% | | | | |

[a,b,c,d,e,f,i,j,k, and l] are the same as the above examples
[m] DTDMAC = Di-Tallow Di-Methyl Ammonium Chloride
[n] DEEDMAC = Di-tallowoylethanolester dimethylammonium chloride
[o] TEA QUAT 1 = N,N-di(canolyl-oxy-ethyl)-N-methyl-N-(2-hydroxyethyl) ammonium methyl sulfate
[p] HCL = Hydrochloric Acid
[q] DC2310 = Silicone sud-suppressor from Dow Corning
[r] CaCl2 = Calcium Chloride
[s] Kathon = mixture of 5-chloro-2-methyl-4-isothiazolin-3-one and 2-methyl-4-isothiazolin-3-one

TABLE III

Detergent Compositions Examples 13-19

| Ingredient | Formulation Example 13 | 14 | 15 | 16 | 17 | 18 | 19 |
|---|---|---|---|---|---|---|---|
| | Wt % | | | | | | |
| PGE-1 [a] | 3 | 3 | 6 | 6 | 0 | 0 | 0 |
| PGE-2 [b] | 0 | 0 | 0 | 0 | 3 | 3 | 6 |
| Perfume | 1.5 | 1.5 | 1.5 | 1.5 | 1.5 | 1.5 | 1.5 |
| Deposition agent-2 [f] | 0.5 | 0 | 0.5 | 0 | 0.5 | 0 | 0.5 |

TABLE III-continued

| Detergent Compositions Examples 13-19 | | | | | | | |
|---|---|---|---|---|---|---|---|
| | Formulation Example | | | | | | |
| | 13 | 14 | 15 | 16 | 17 | 18 | 19 |
| Ingredient | Wt % | | | | | | |
| Deposition agent-3 [g] | 0 | 0.5 | 0 | 0.5 | 0 | 0.5 | 0 |
| NI 45-8 [t] | 6.25 | 6.25 | 6.25 | 6.25 | 6.25 | 6.25 | 6.25 |
| AES [u] | 10.6 | 10.6 | 10.6 | 10.6 | 10.6 | 10.6 | 10.6 |
| Citric Acid | 4.72 | 4.72 | 4.72 | 4.72 | 4.72 | 4.72 | 4.72 |
| HLAS [v] | 0.78 | 0.78 | 0.78 | 0.78 | 0.78 | 0.78 | 0.78 |
| TPK FA [w] | 8.75 | 8.75 | 8.75 | 8.75 | 8.75 | 8.75 | 8.75 |
| Zwitterionic Ethylene Diamine [x] | 1.4 | 1.4 | 1.4 | 1.4 | 1.4 | 1.4 | 1.4 |
| DTPMP [y] | 0.21 | 0.21 | 0.21 | 0.21 | 0.21 | 0.21 | 0.21 |
| Ethanol | 2.75 | 2.75 | 2.75 | 2.75 | 2.75 | 2.75 | 2.75 |
| Boric Acid | 2.39 | 2.39 | 2.39 | 2.39 | 2.39 | 2.39 | 2.39 |
| Sodium Hydroxide | 5.79 | 5.79 | 5.79 | 5.79 | 5.79 | 5.79 | 5.79 |
| Water | Balance to 100% | | | | | | |

[a, b, f and g] are the same as the above examples

[s] NI 45- 8 = alcohol ethoxylate with an approximate average chainlength of C14, C15 and an average of 8 ethoxylates.

[t] AES = alkyl ethoxylate sulfate

[u] HLAS = H linear alkylbenzene solfonate

[v] TPK FA = Tall Palm Kernel Fatty Acid

[w] As described in WO01/62882 and 6,444,633 (Quaternized trans sulfated hexamethylene-diamine)

[x] DTPMP = diethylene triamine penta(methyl Phosphonic) acid

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising a polyglycerol ester having the structure of Formula I (Formula I)

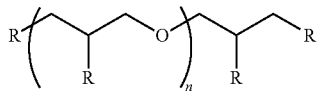

wherein each R is independently selected from the group consisting of fatty acid ester moieties comprising carbon chains, said carbon chains having a carbon chain length of from about 15 to about 22 carbon atoms; OH; and combinations thereof; said polyglycerol ester having an iodine value of 0 to about 45;

wherein a) when n is from about 1.5 to about 6, the average % esterification of said polyglycerol ester is from about 20% to about 100%;

b) when n is from about 1.5 to about 5, the average % esterification is from about 20% to about 90% c) when n is from about 1.5 to about 4, the average % esterification is from about 20% to about 80%;

wherein more than about 50% of said polyglycerol ester in said composition has at least two ester linkages; one or more cyclic polyglycerol molecules; and a treatment and/or care agent.

2. A composition according to claim 1 comprising the polyglycerol ester of Formula I wherein said fatty acid moieties' carbon chains have an average carbon chain length of from about 16 to about 18 carbon atoms; wherein said polyglycerol ester has an iodine value of from 0 to about 20; wherein a) when n is from about 1.5 to about 3.5, the % esterification is from about 20% to about 60%;

b) when n is from about 1.5 to about 4.5, the % esterification is from about 20% to about 70%; and c) when n is from about 1.5 to about 6, the % esterification is from about 20% to about 80%.

3. A composition according to claim 1 wherein when n is from about 1.5 to about 6, the % esterification is from about 20% to about 80%.

4. A composition according to claim 1 wherein each R is independently selected from the group consisting of fatty acids having a carbon chain lengths of from about 15 to about 18 carbon atoms; OH; and combinations thereof, wherein said fatty acids are selected from the group consisting of saturated fatty acids; unsaturated fatty acids; and combinations thereof.

5. A composition according to claim 1 comprising from about 50% to about 100% of an ester that is a diester or higher.

6. A composition according to claim 1, wherein said polyglycerol ester comprises less than about 50% of a monoester.

7. A composition according to claim 1, wherein said treatment and/or care agent comprises a material selected from the group consisting of polymers, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, perfume, perfume delivery systems, structure elasticizing agents, fabric softeners, carriers, hydrotropes, processing aids and/or pigments.

8. A composition according to claim 1, wherein said composition comprises an organosilicone.

9. A composition according to claim 1, said organosilicone being selected from the group consisting of (a) non-functionalized siloxane polymers, (b) functionalized siloxane polymers, and combinations thereof.

10. A composition comprising a polyglycerol ester having the structure of Formula I (Formula I)

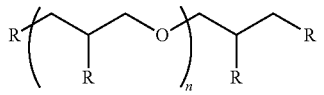

wherein each R is independently selected from the group consisting of fatty acid ester moieties comprising carbon chains, said carbon chains having a carbon chain length of from about 10 to about 22 carbon atoms; OH; and combinations thereof; wherein a) when n is from about 1.5 to about 6, the average % esterification of said polyglycerol ester is from about 20% to about 100%;

b) when n is from about 1.5 to about 5, the average % esterification is from about 20% to about 90% c) when n is from about 1.5 to about 4, the average % esterification is from about 20% to about 80%;

wherein more than about 50% of said polyglycerol ester in said composition has at least two ester linkages; one or more cyclic polyglycerol molecules; and a treatment and/or care agent that comprises a quaternary ammonium compound.

11. A composition according to claim 10, said composition comprising a ratio of the polyglycerol ester to the quaternary ammonium compound of from about 10:1 to about 1:5.

12. An article comprising a polyglycerol ester having the structure of Formula I (Formula I)

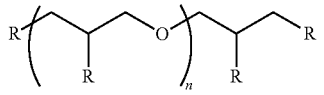

wherein each R is independently selected from the group consisting of fatty acid ester moieties comprising carbon chains, said carbon chains having a carbon chain length of from about 10 to about 22 carbon atoms; OH; and combinations thereof; wherein a) when n is from about 1.5 to about 6, the average % esterification of said polyglycerol ester is from about 20% to about 100%;

b) when n is from about 1.5 to about 5, the average % esterification is from about 20% to about 90% c) when n is from about 1.5 to about 4, the average % esterification is from about 20% to about 80%;

wherein more than about 50% of said polyglycerol ester in said composition has at least two ester linkages; one or more cyclic polyglycerol molecules; and a treatment and/or care agent.

13. A method of treating and/or cleaning a situs comprising the steps of a) optionally washing and/or rinsing said situs; b) contacting said situs with a composition comprising a polyglycerol ester having the structure of Formula I (Formula I)

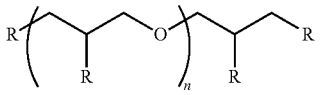

wherein each R is independently selected from the group consisting of fatty acid ester moieties comprising carbon chains, said carbon chains having a carbon chain length of from about 10 to about 22 carbon atoms; OH; and combinations thereof; wherein a) when n is from about 1.5 to about 6, the average % esterification of said polyglycerol ester is from about 20% to about 100%;

b) when n is from about 1.5 to about 5, the average % esterification is from about 20% to about 90% c) when n is from about 1.5 to about 4, the average % esterification is from about 20% to about 80%;

wherein more than about 50% of said polyglycerol ester in said composition has at least two ester linkages; one or more cyclic polyglycerol molecules; and a treatment and/or care agent; and c) optionally, washing and/or rinsing said situs.

14. A method of providing a freshness benefit to a textile, comprising applying the composition of claim 1 to a textile, wherein said treatment and/or care agent comprises a perfume.

15. A composition according to claim 1, wherein said composition comprises a perfume containing microcapsule.

* * * * *